US010256570B2

(12) United States Patent
Shinmi

(10) Patent No.: US 10,256,570 B2
(45) Date of Patent: Apr. 9, 2019

(54) LEVER CONNECTOR

(71) Applicant: YAZAKI CORPORATION, Tokyo (JP)

(72) Inventor: Yoshifumi Shinmi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/986,798

(22) Filed: May 22, 2018

(65) Prior Publication Data

US 2018/0351293 A1 Dec. 6, 2018

(30) Foreign Application Priority Data

Jun. 6, 2017 (JP) ..... 2017-111898

(51) Int. Cl.
*H01R 13/62* (2006.01)
*H01R 13/629* (2006.01)

(52) U.S. Cl.
CPC ..... *H01R 13/62938* (2013.01)

(58) Field of Classification Search
CPC ..... H01R 13/62938; H01R 13/62955
See application file for complete search history.

(56) References Cited

U.S. PATENT DOCUMENTS 6,264,485 B1 7/2001 Saka et al.
2007/0026706 A1 2/2007 Matsubara et al.
2007/0293070 A1 12/2007 Takahashi
2009/0075506 A1 3/2009 Suzuki
2015/0079830 A1* 3/2015 Iwatani ..... H01R 13/6295 439/310
2016/0141798 A1* 5/2016 Kawashima ..... H01R 13/62938 439/157
2016/0172788 A1* 6/2016 Iida ..... H01R 13/62938 439/157
2016/0261069 A1* 9/2016 Noro ..... H01R 13/62955
2018/0248311 A1* 8/2018 Shinmi ..... H01R 13/62938
2018/0248312 A1* 8/2018 Shinmi ..... H01R 13/62955

FOREIGN PATENT DOCUMENTS

JP 2001-118631 A 4/2001
JP 2007-35593 A 2/2007
JP 2008-4271 A 1/2008
JP 2009-70754 A 4/2009
JP 2009-117059 A 5/2009

* cited by examiner

*Primary Examiner* — Xuong M Chung Trans
(74) *Attorney, Agent, or Firm* — Kenealy Vaidya LLP

(57) ABSTRACT

A lever connector includes a lever which includes a lever-side lock part configured to be elastically deformed in a first direction to be separated from a surface of a second housing and configured to be locked to a housing-side lock part of the second housing when the lever is in a fitting start position. A first housing includes a pressing part configured to move together with the first housing in a fitting direction at a time of fitting, and configured to release a lock between the lever-side lock part and the housing-side lock part by pressing the lever-side lock part in the first direction. The second housing includes a lap part configured to be brought into close contact with an edge part of the lever when the lever is in a fitting completion position, so as to prevent that the edge part is deformed in the first direction.

3 Claims, 13 Drawing Sheets

LEVER CONNECTOR

CROSS REFERENCE TO RELATED APPLICATIONS

This application is based on Japanese Patent Application (No.P2017-111898) filed on Jun. 6, 2017, the contents of which are incorporated herein by way of reference.

BACKGROUND

The present invention relates to a lever connector which includes a first housing and a second housing which are fittable to each other, and a lever mounted in the second housing.

In the related art, a lever connector is proposed which includes a lever which assists fitting of a male housing and a female housing (for example, see JP-A-2009-117059, JP-A-2007-035593, JP-A-2009-070754, JP-A-2001-118631, and JP-A-2008-004271).

For example, in one of the lever connectors in the related art (hereinafter, referred to as "a connector of the related art"), a lever is turnably mounted in one housing, and a protrusion pin is provided in the other housing. Further, when the lever is turned from a fitting start position to a fitting completion position in a state where the protrusion pin is inserted into a cam hole of the lever, both housings are pulled to be close to each other such that the both housings are fitted in each other (for example, see JP-A-2009-117059).

SUMMARY

An object thereof is to provide a lever connector which has excellent tolerance to a vibration or an external force applied from the outside.

In order to achieve the object described above, a lever connector according to the invention includes the following characteristics [1] to [3] below.

[1] A lever connector including:

a first housing;

a second housing, configured to be fit to the first housing, and including a housing-side lock part; and a lever, mounted in the second housing, and configured to be moved from a fitting start position to a fitting completion position, wherein the lever includes a lever-side lock part configured to be elastically deformed in a first direction to be separated from a surface of the second housing and configured to be locked to the housing-side lock part when the lever is in the fitting start position, the first housing includes a pressing part configured to move together with the first housing in a fitting direction at a time of fitting, and configured to release a lock between the lever-side lock part and the housing-side lock part by pressing the lever-side lock part in the first direction, and the second housing includes a lap part configured to be brought into close contact with an edge part of the lever when the lever is in the fitting completion position, so as to prevent that the edge part is deformed in the first direction.

[2] The lever connector according to the above [1], wherein the second housing includes a projection part which protrudes to push the edge part toward the lap part, when the lever is in the fitting completion position.

[3] The lever connector according to the above [1] or [2], wherein the lever includes a guide part provided in the edge part and configured to move together with the lever at the time of fitting, and the guide part is not covered with the lap part when the lever is in the fitting start position, and is covered with the lap part when the lever is in the fitting completion position.

DETAILED DESCRIPTION OF EXEMPLIFIED EMBODIMENTS

The lever connector such as the connector of the related art may be mounted in a vehicle such as an automobile after the fitting. In this case, a vibration or an external force is applied to the lever connector from the outside. For this reason, the lever connector is desirably formed to maintain a function as the lever connector even when the vibration or the external force is applied.

The invention has been made in consideration of the above situation, and an object thereof is to provide a lever connector which has excellent tolerance to a vibration or an external force applied from the outside.

Embodiment

Hereinafter, a lever connector 1 according to an embodiment of the invention will be described with reference to the drawings.

Figure 1A:
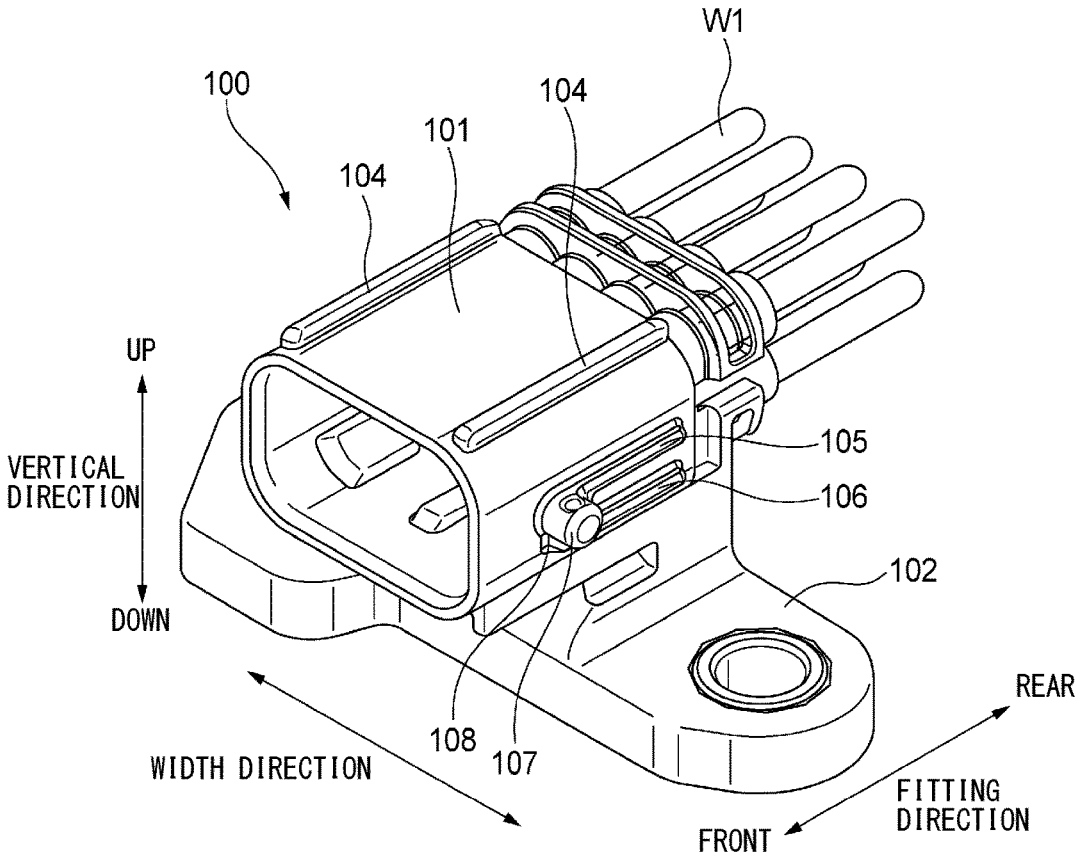
FIG. 1A is a perspective view illustrating a male housing included in a lever connector according to an embodiment of the invention when viewed from a front side.
Figure 1B:
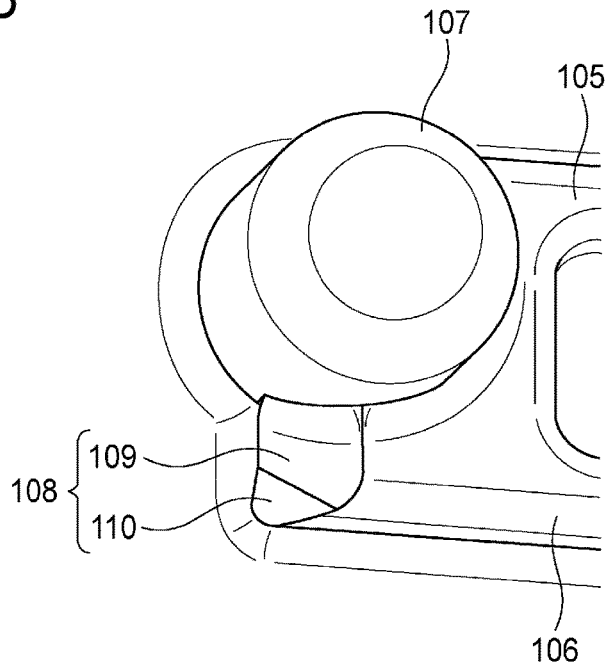
FIG. 1B is an enlarged perspective view illustrating a periphery of a cam boss illustrated in FIG. 1A.
Figure 2A:
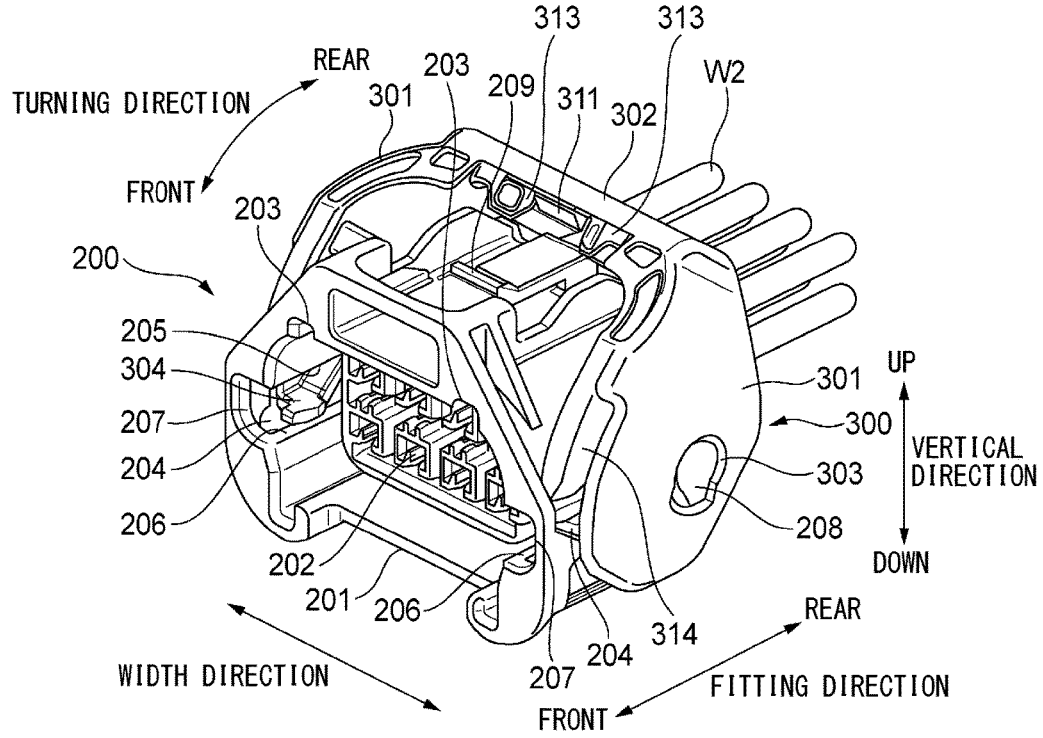
FIG. 2A is a perspective view illustrating a female housing which is included in the lever connector according to the embodiment of the invention and is mounted with a lever when viewed from the front side.
Figure 2B:
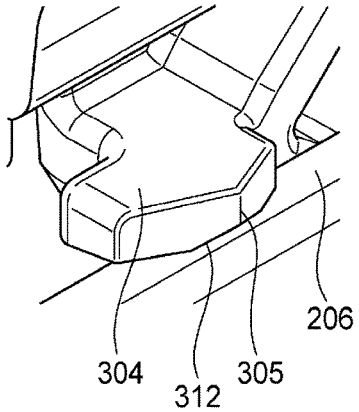
FIG. 2B is an enlarged perspective view illustrating a periphery of a lever-side lock part illustrated in FIG. 2A.
Figure 2C:
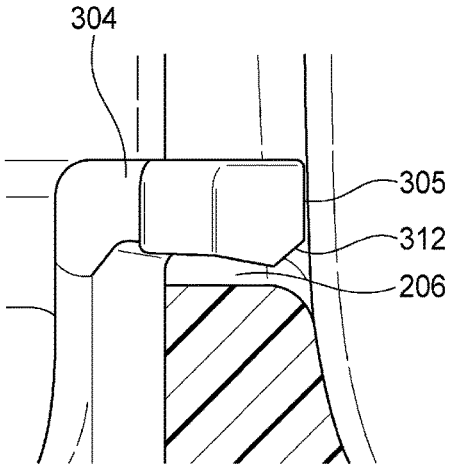
FIG. 2C is an enlarged front view illustrating the periphery of the lever-side lock part.

The lever connector 1 according to the embodiment of the invention includes a male housing 100 illustrated in FIGS. 1A and 1B, a female housing 200 which is fitted in the male housing 100 to house the male housing 100 (such that the male housing 100 is inserted inward) and is illustrated in FIGS. 2A to 2C, and a lever 300 which is turnably mounted in the female housing 200 and is illustrated in FIGS. 2A to 2C.

Hereinafter, "fitting direction", "width direction", "vertical direction", "front", "rear", "up", "down", and "turning direction" of the lever 300 are defined as illustrated in FIGS. 1A to 2C. The "fitting direction", the "width direction", and the "vertical direction" are orthogonal to each other. Further, "a time when the male housing 100 and the female housing 200 are fitted to each other" is simply referred to as "a time of fitting". FIGS. 2A to 2C illustrate a state where the lever 300 is in the temporary locking position (fitting start position), and the lever 300 is turned from the temporary locking position (fitting start position) to the front side of the turning direction to move toward a final locking position (fitting completion position).

As illustrated in FIG. 1A, the male housing 100 is made of resin, and includes a body circumferential wall 101 which is long in a width direction and has a rectangular cylindrical shape, and a stay part 102 which integrally extends from the lower end part of the body circumferential wall 101 in the width direction. A plurality of terminal housing chambers 103 (see FIGS. 4B and 4C) which respectively house a plurality of male terminals T1 (see FIGS. 4B and 4C) respectively connected in end parts of a plurality of (in this example, eight) of electric wires W1 are formed inside the body circumferential wall 101 along the fitting direction.

A pair of upper surface ribs 104 are formed near both widthwise ends of the upper surface of the body circumferential wall 101. The pair of upper surface ribs 104 protrude upward, and extend in parallel with each other in the fitting direction over the almost entire area of the body circumferential wall 101 in the fitting direction. An upper rib 105 and a lower rib 106 are formed in the upper portion and the lower portion of both side surfaces of the body circumferential wall 101, respectively. The upper rib 105 and the lower rib 106 protrude to the widthwise outer side, and extend in parallel with each other in the fitting direction from the vicinity of the rear end part of the body circumferential wall 101 to a slightly front position from the center in the fitting direction. The cam boss 107 is formed in each of both side surfaces of the body circumferential wall 101. The cam boss 107 is formed in the position adjacent to the front end part of the upper rib 105 and the lower rib 106, and protrudes to the widthwise outer side further than the upper rib 105 and the lower rib 106. As illustrated in FIG. 1B, the cross-sectional shape (the shape of the sectional surface of the cam boss 107 orthogonal to the protruding direction) of the cam boss 107 is formed to be an elliptical shape in which a long diameter extends in the fitting direction (see also FIG. 5 and others).

As illustrated in FIG. 1B, the front end part of the lower rib 106 positioned adjacent to the cam boss 107 functions as a pressing part 108 which presses the lever-side lock part 304 (see FIGS. 4A and others) of the lever 300 to the widthwise outer side at the time of fitting (to be described in detail below). The pressing part 108 includes a pressing surface 109 and a tilted surface 110.

The pressing surface 109 forms the upper area of the pressing part 108, and is positioned just below the cam boss 107. The pressing surface 109 is a flat surface which is tilted toward the widthwise outer side with respect to a flat surface perpendicular to the fitting direction. In other words, the pressing surface 109 is a flat surface of which the normal vector has only a component in a front direction and a component in a widthwise outer direction.

The tilted surface 110 forms the lower area of the pressing part 108, and is continuous to the lower end edge of the pressing surface 109. The tilted surface 110 is a flat surface which is tilted toward the widthwise outer side and the lower side with respect to the flat surface perpendicular to the fitting direction. In other words, the tilted surface 110 is a flat surface of which the normal vector has a component in the front direction, a component in the widthwise outer direction, and a component in a lower direction. The functions of the pressing surface 109 and the tilted surface 110 and the like will be described below.

As illustrated in FIG. 2A, the female housing 200 is made of resin, and includes a body circumferential wall 201 which is long in the width direction and has a rectangular cylindrical shape. At the time of fitting, the male housing 100 and the female housing 200 are fitted such that the circumferential surface of the body circumferential wall 201 and the outer circumferential surface of the body circumferential wall 101 of the male housing 100 are overlapped with each other (see FIGS. 3, 4B, 4C, and 5). A plurality of terminal housing chambers 202 (see FIGS. 4B and 4C) which respectively house a plurality of female terminals T2 (see FIGS. 4B and 4C) respectively connected in the end parts of a plurality of (in this example, eight) the electric wires W2 are formed inside the body circumferential wall 201 along the fitting direction.

A pair of upper-surface groove parts 203 are formed in the vicinity of both widthwise ends of the inner surface of the upper wall of the body circumferential wall 201. The pair of upper-surface groove parts 203 are concave upward, and extend in the fitting direction in parallel with each other from the front end of the body circumferential wall 201 toward the rear side. A window (through hole) 204 extending in the fitting direction is formed in each of both side walls of the body circumferential wall 201. An upper edge surface 205 and a lower edge surface 206 of the window 204 extend in the fitting direction in parallel with each other from the front end of the body circumferential wall 201 toward the rear side. A side-surface groove part 207 which is continuous to the front end parts of the upper edge surface 205 and the lower edge surface 206 of the window 204, and is concave to the widthwise outer side is formed in each of the front end parts of the inner surfaces of the both side walls of the body circumferential wall 201.

At the time of fitting, the pair of upper surface ribs 104 of the male housing 100 are inserted and guided to the pair of upper-surface groove parts 203, the pair of cam bosses 107 of the male housing 100 pass through the pair of side-surface groove parts 207, and the pair of the upper rib 105 and the lower rib 106 of the male housing 100 abut on and are guided to the upper edge surface 205 and the lower edge surface 206 of a pair of windows 204, respectively.

A rotary shaft 208 which protrudes to the widthwise outer side is formed in each of predetermined positions of the rear sides of both side surfaces of the body circumferential wall 201. A pair of holes 303 (a connection part of the lever 300 and the female housing 200) of the lever 300 are fitted into a pair of rotary shafts 208. Accordingly, the lever 300 is mounted in the female housing 200 to be turnable about the pair of rotary shafts 208. A cut-off part 208*a* for preventing a concaveness and the like (a so-called sink) caused by molding and contraction is provided in the outer circumferential surface of each of the rotary shafts 208 (see FIGS. 11A to 12). The arrangement of the cut-off part 208*a* and the like will be described below.

Figure 4A:
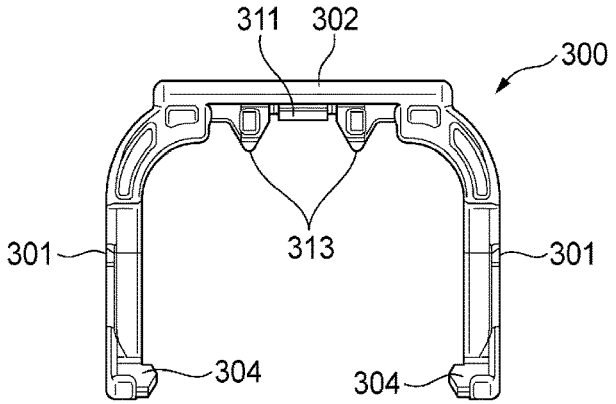
FIG. 4A is a front view of the lever.
Figure 4B:
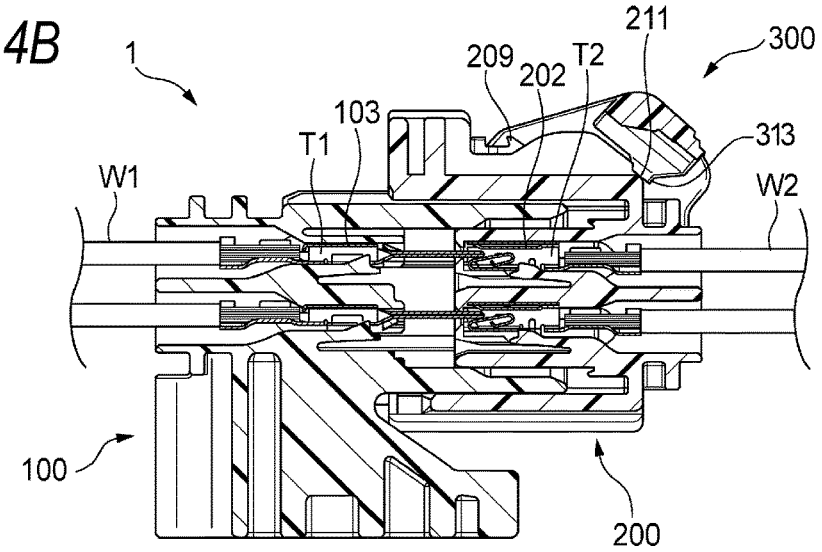
FIG. 4B is a sectional view illustrating a state where the lever is in a temporary locking position, corresponding to the cross section taken along line A-A of FIG. 3.

A lock beak 209 protruding upward is formed in the widthwise central portion of the upper surface of the body circumferential wall 201 (see FIG. 4B). The lock beak 209 is provided to hold the lever 300, which is in the final locking position, in the final locking position (to be described in detail below).

A receiving surface 210 (flat surface) which extends to be tilted toward the lower side and to the widthwise inner side from the lower edge surface 206 of the window 204 is formed in each of the front areas of both side surfaces of the body circumferential wall 201 (see FIGS. 5, 6A to 6C, and 8A to 8C). The function of the receiving surface 210 and the like will be described below.

As illustrated in FIGS. 2A and 4A, the lever 300 is made of resin, and has a substantially U shape including a pair of arm parts 301 and a connection part 302 which connects one ends of the pair of arm parts 301. The pair of holes 303 which are through holes are formed in the pair of arm parts 301. When the pair of rotary shafts 208 of the female housing 200 are inserted into the pair of holes 303, the lever 300 is turnable with respect to the female housing 200 (about the pair of rotary shafts 208) in a state where the pair of arm parts 301 hold both side surfaces of the female housing 200.

The lever-side lock part 304 protruding to the widthwise inner side is integrally formed adjacent to the other end parts (free end part) of the pair of arm parts 301, respectively. As illustrated in FIGS. 2A to 2C, in the state where the lever 300 is in the temporary locking position, the pair of lever-side lock parts 304 enter the pair of windows 204 of the female housing 200, and are locked such that the pair of lever-side lock parts 304 are interposed between the upper edge surface 205 and the lower edge surface 206. By locking the lever-side lock part 304, the lever 300 is locked in the temporary locking position, so as to prohibit the movement of the lever 300 to the final locking position.

As described above, in the pair of lower edge surfaces 206 of the pair of windows 204, the lever-side lock part 304 (of the lever 300 which is in the temporary locking position) before the lock is released functions as a lock wall, which is provided to prevent the movement of the lever-side lock part 304, on a passage which allows the movement to the front side in the turning direction according to the movement of the lever 300 in the final locking position.

A protrusion part 305 protruding to the widthwise inner side is formed in each of the lever-side lock parts 304. In addition, in the lower surface (that is, a wall surface facing the lower edge surface 206) of each of the lever-side lock parts 304, the widthwise inner edge portion is chamfered by providing a taper surface 312. The taper surface 312 is a flat surface which is tilted toward the widthwise inner side with respect to the flat surface perpendicular to the vertical direction. In other words, the taper surface 312 is a flat surface of which the normal vector has only a component in a widthwise inner direction and a component in the lower direction. The function of the taper surface 312 and the like will be described below.

Figure 8C:
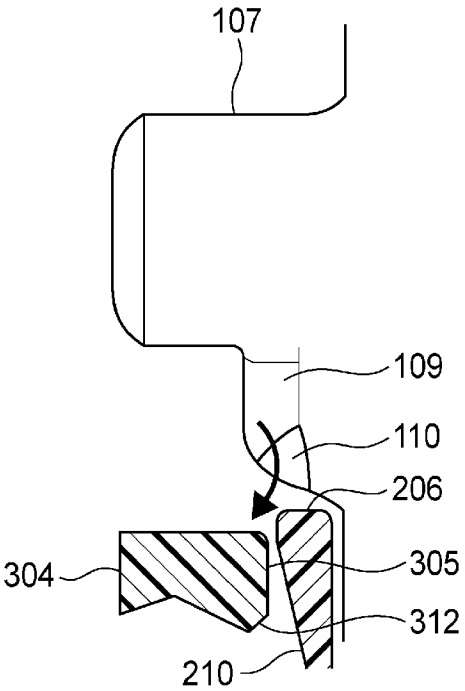
FIG. 8C is a sectional view taken along line E-E of FIG. 6C.
Figure 8B:
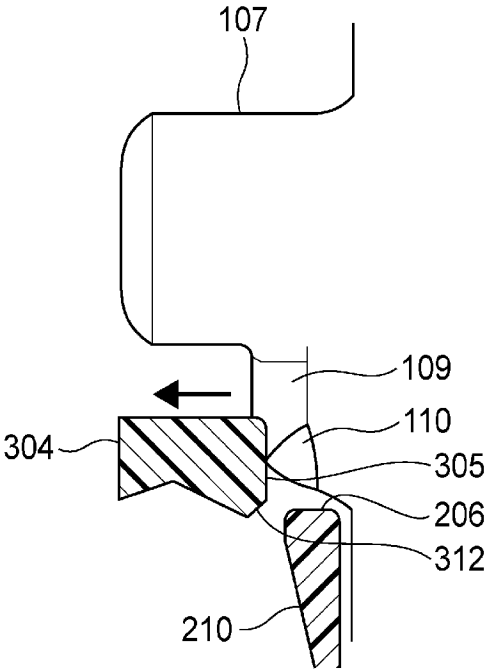
FIG. 8B is a sectional view taken along line D-D of FIG. 6B.
Figure 9A:
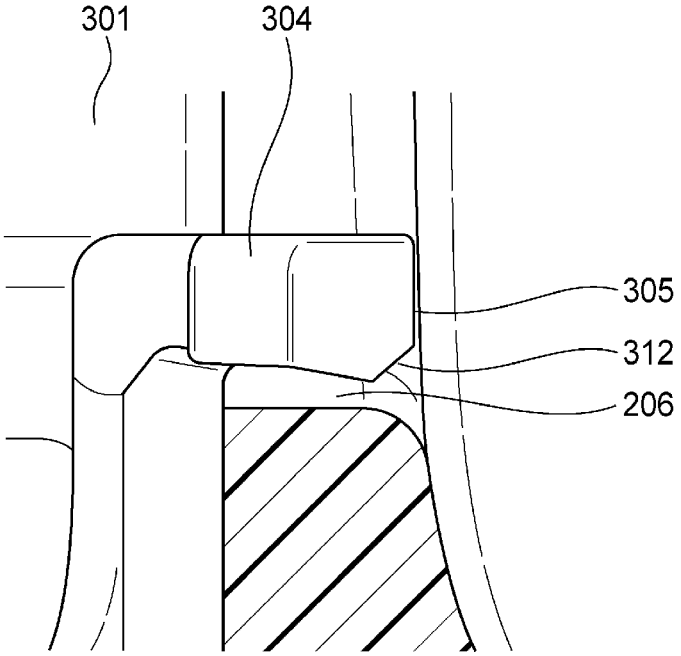
FIG. 9A is an enlarged front view illustrating the periphery of the lever-side lock part in the state illustrated in FIG. 8A.
Figure 9B:
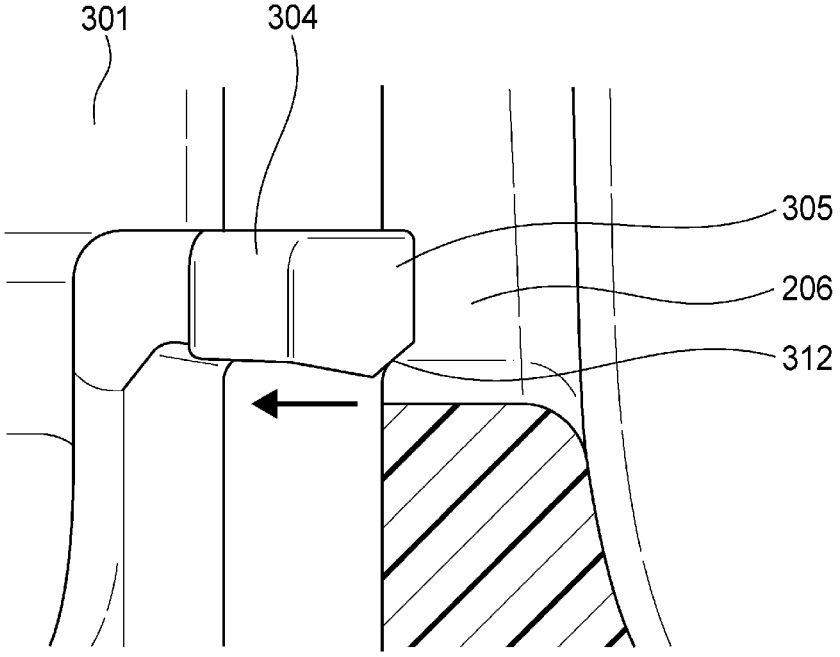
FIG. 9B is an enlarged front view illustrating the periphery of the lever-side lock part in the state illustrated in FIG. 8B.

At the time of fitting, the protrusion parts 305 of the pair of lever-side lock parts 304 are pressed by the pressing parts 108 (more specifically, the pressing surface 109, see FIG. 1B) which are positioned adjacent to the pair of cam bosses 107 of the male housing 100, so that the pair of lever-side lock parts 304 are elastically deformed to the widthwise outer side (see arrows of FIGS. 8B and 9B). As a result, the lock of the lever-side lock part 304 in the lower edge surface 206 is released, and the lever 300 can move to the front side in the turning direction from the temporary locking position toward the final locking position.

Figure 5:
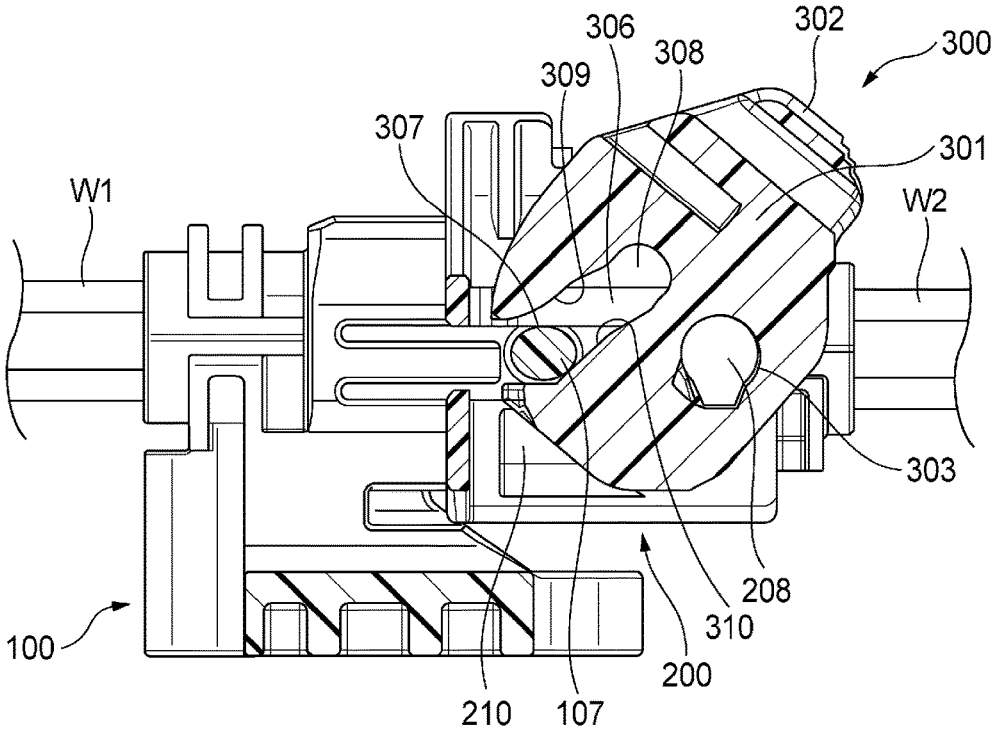
FIG. 5 is a sectional view illustrating a state where the lever is in the temporary locking position, corresponding to the cross section taken along line B-B of FIG. 3.

A cam groove 306 is formed in each of the widthwise inner surfaces of the pair of arm parts 301 (for example, see FIGS. 5 and the like). A pair of cam grooves 306 are provided such that the pair of cam bosses 107 of the male housing 100 are pulled from an inlet part 307 of the cam groove 306 to an innermost part 308 at the time of fitting when the lever 300 is turned from the temporary locking position to the final locking position (to be described in detail below). Incidentally, the cam groove 306 is defined by a side wall 309 which is positioned on the rear side in the turning direction, and a side wall 310 which is continuous to the side wall 309 and is positioned on the front side in the turning direction.

A lock beak holding part 311 is formed in the widthwise central portion of the front end part of the turning direction of the connection part 302 of the lever 300 (see FIG. 2A and 4A). The lock beak holding part 311 is provided to collaborate with the lock beak 209 (see FIGS. 2A and 4B) of the female housing 200 and hold the lever 300, which is in the final locking position, in the final locking position. Specifically, when the lever 300 reaches the final locking position from the temporary locking position, the lock beak holding part 311 abuts on and is held by the lock beak 209. As a result, the lever 300 which is in the final locking position is held in the final locking position. On the other hand, when the holding of the lock beak 209 by the lock beak holding part 311 is released from the state, the lever 300 can move from the final locking position toward the temporary locking position (to the rear side in the turning direction).

A pair of frictional ribs 313 which protrude toward the body circumferential wall 201 of the female housing 200 further than the lock beak holding part 311 are formed in the positions adjacent to the both widthwise sides of the lock beak holding part 311 in the connection part 302 of the lever 300 (see FIGS. 2A, and 4A to 4C).

Figure 4C:
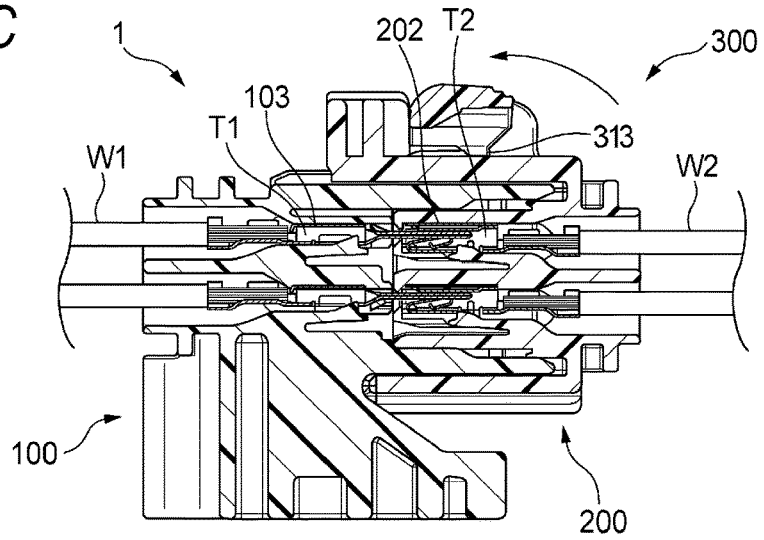
FIG. 4C is a sectional view illustrating a state where the lever is in a final locking position, corresponding to the cross section taken along line A-A of FIG. 3.

As illustrated in FIG. 4B, when the lever 300 is in the temporary locking position, the frictional rib 313 abuts on a rear-side end part 211 (see FIG. 4B) of the upper wall of the body circumferential wall 201. Further, as illustrated in FIG. 4C, when the lever 300 is in the final locking position, the frictional rib 313 abuts on a predetermined place of the upper wall of the body circumferential wall 201.

Accordingly, when the lever 300 is in the temporary locking position and when the lever 300 is in the final locking position, even in a case where the large external force is applied to the lever 300, it is prevented that the connection part 302 is deformed to be close to the body circumferential wall 201 of the female housing 200, and the pair of arm parts 301 are deformed according to the deformation of the connection part in a direction to be separated from the surface (the side surface of the body circumferential wall 201) of the female housing 200. As a result, compared to a case where the pair of frictional ribs 313 are not provided, a possibility is reduced that the lever 300 is deviated unintentionally from the female housing 200.

Incidentally, in all the processes where the lever 300 moves from the temporary locking position to the final locking position, it may be configured that the pair of frictional ribs 313 continuously abut on the surface of the body circumferential wall 201 of the female housing 200. Accordingly, in all the processes where the lever 300 moves from the temporary locking position to the final locking position, the pair of frictional ribs 313 continuously abut on the surface of the body circumferential wall 201 of the female housing 200, and thus it can be prevented more reliably that the lever 300 is deviated unintentionally from the female housing 200.

Figure 10A:
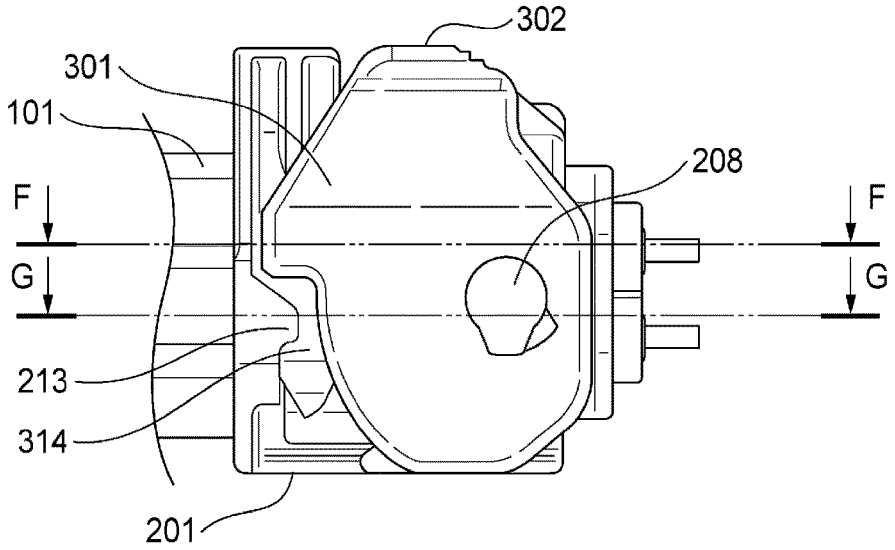
FIG. 10A is a side view of the lever connector which is in a fitting completion state.

As illustrated in FIG. 10A, in an edge part of each of the pair of arm parts 301 of the lever 300, a guide part 314 (see FIG. 2A) which extends downward from the predetermined position of the front end of the arm part 301 when the lever 300 is in the final locking position is provided integrally with the arm part 301.

Figure 10B:
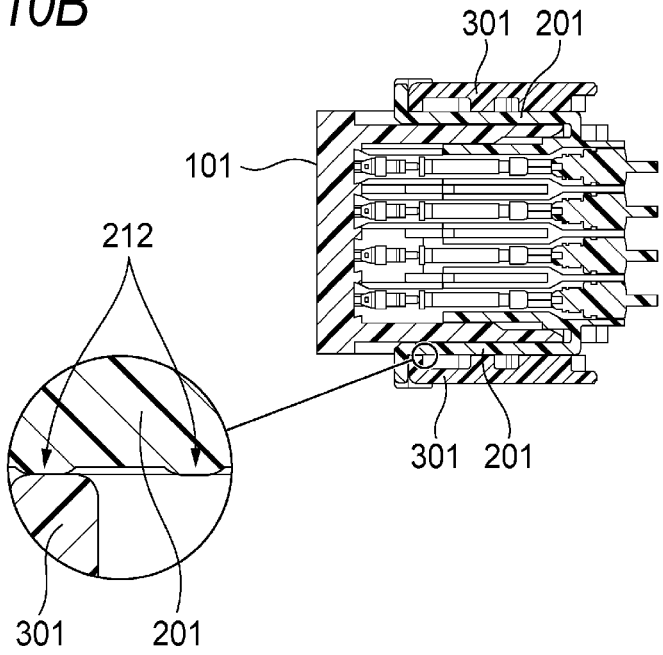
FIG. 10B is a sectional view taken along line F-F of FIG. 10A.
Figure 10C:
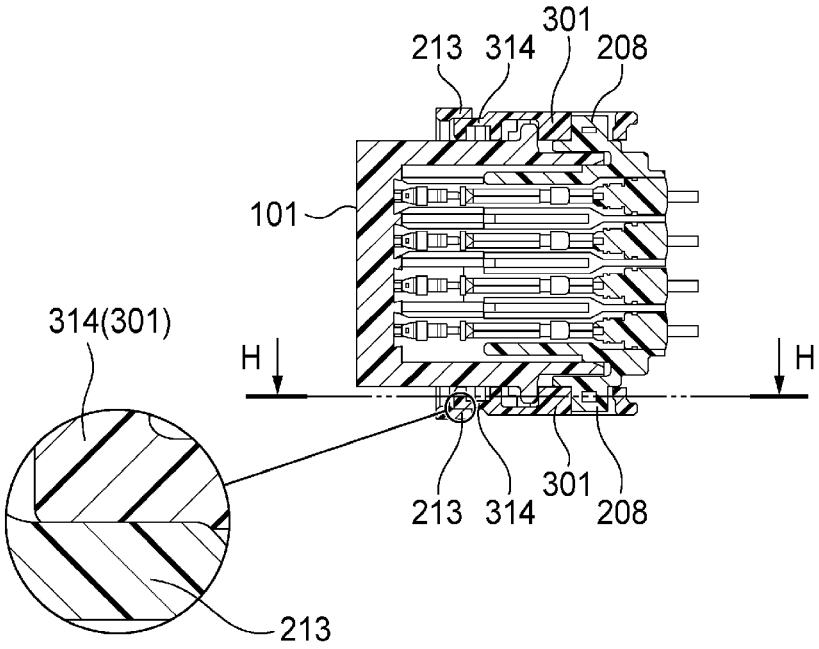
FIG. 10C is a sectional view taken along line G-G of FIG. 10A.

As illustrated in FIG. 10B which is a sectional view taken along line F-F of FIG. 10A, in each of the pair of side walls of the body circumferential wall 201 of the female housing 200, a projection 212 protruding to the widthwise outer side is formed in a position in which the projection faces the inner wall of the arm part 301 positioned slightly upward from the root part of the guide part 314 when the lever 300 is in the final locking position. In addition, in each of the front end parts of the pair of side walls of the body circumferential wall 201, a nipping wall 213 extending in the fitting direction is formed to be separated to the widthwise outer side by a predetermined distance from the front end part of the side wall so as to face the front end part of the side wall.

In the middle stage in which the lever 300 is directed from the temporary locking position toward the final locking position, when the guide part 314 enters a space between the nipping wall 213 and the side wall of the body circumferential wall 201, so that the lever 300 is in the final locking position, the guide part 314 is nipped in the width direction between the nipping wall 213 and the side wall of the body circumferential wall 201.

Herein, the projection 212 and the nipping wall 213 are arranged and formed such that when the lever 300 is in the final locking position (that is, when the lever connector 1 is in the fitting completion state), the projection 212 presses the arm part 301 toward the widthwise outer side, and the nipping wall 213 presses the guide part 314 integral with the arm part 301 to the widthwise inner side. That is, the guide part 314 is brought into close contact with the nipping wall 213. Accordingly, even when the lever connector 1 which is in the fitting completion state receives the vibration at the time of conveyance or the like, the lever 300 does not rattle. Accordingly, it is possible to prevent that the noise is generated due to the rattling of the lever 300. Further, it is possible to prevent that a frictional abrasion of the rotary shaft 208 and the cam boss 107 is generated due to the rattling of the lever 300.

Hereinafter, an operation that the male housing 100 is fitted in the female housing 200 will be described with reference to FIGS. 3 to 9B.

Figure 6A:
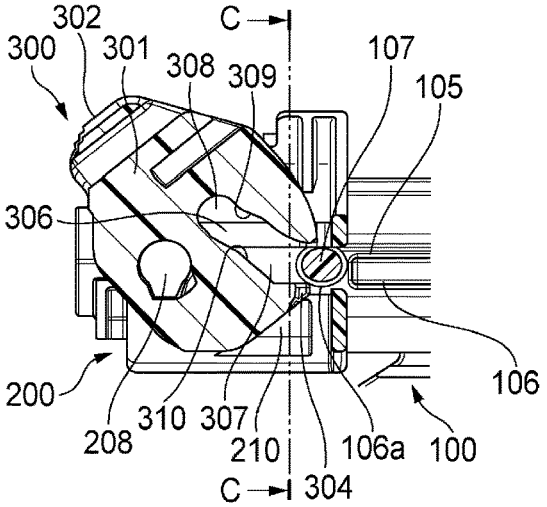
FIG. 6A illustrates a positional relation of the cam boss and the lever in a stage before the fitting start state of the male housing and the female housing.

First, the front surfaces of the female housing 200 and the male housing 100 in which the lever 300 is locked in the temporary locking position are arranged to face each other, and the male housing 100 is inserted into the female housing 200 as illustrated in FIG. 6A. FIG. 6A illustrates a stage before the fitting start state.

Figure 8A:
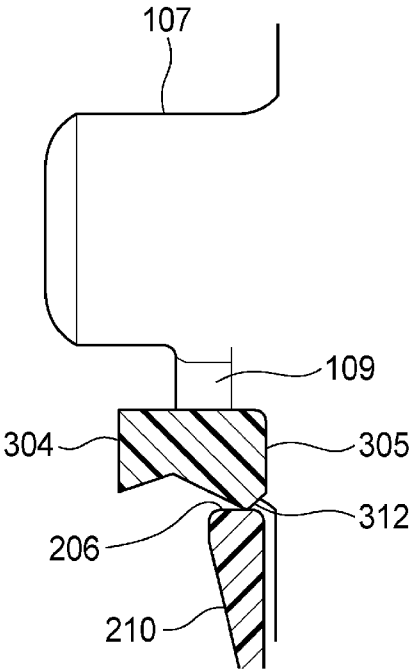
FIG. 8A is a sectional view taken along line C-C of FIG. 6A.

In the stage illustrated in FIG. 6A, the protrusion parts 305 of the pair of lever-side lock parts 304 of the lever 300 are not pressed by the pressing parts 108 (more specifically, the pressing surface 109, see FIG. 1B) of the pair of lower ribs 106 of the male housing 100. Accordingly, as illustrated in FIGS. 8A and 9A, (the lower surfaces of) the pair of lever-side lock parts 304 are locked in the lower edge surfaces 206 of the pair of windows 204 of the female housing 200, so as to prohibit the movement of the lever 300 in the final locking position.

Figure 3:
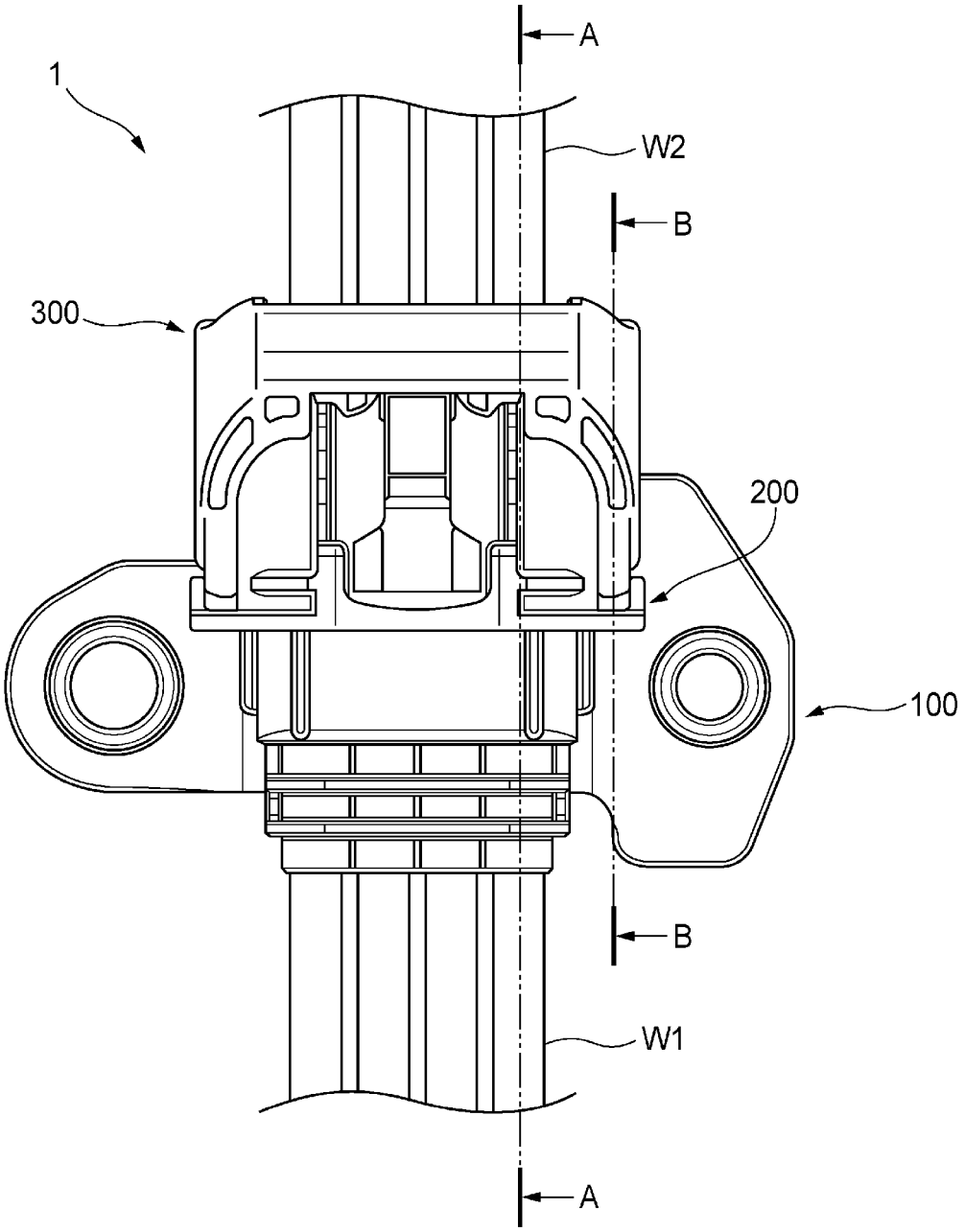
FIG. 3 is a plan view illustrating a fitting start state of the male housing and the female housing.
Figure 6B:
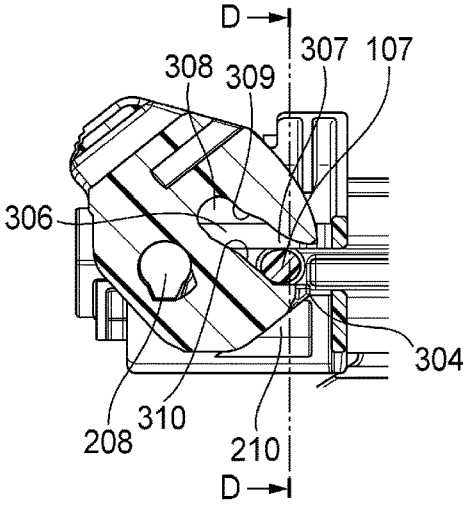
FIG. 6B illustrates the positional relation of the cam boss and the lever in the fitting start state of the male housing and the female housing.

Next, as illustrated in FIG. 6B, the male housing 100 is pressed further with respect to the female housing 200 in the fitting direction to be inserted to the fitting start state (also see FIGS. 3, 4B, and 5). In the fitting start state, as illustrated in FIG. 6B, the pair of cam bosses 107 of the male housing 100 are positioned in the inlet parts 307 of the pair of cam grooves 306 of the lever 300, and start to contact with the side walls 310 of the cam groove 306.

Figure 7A:
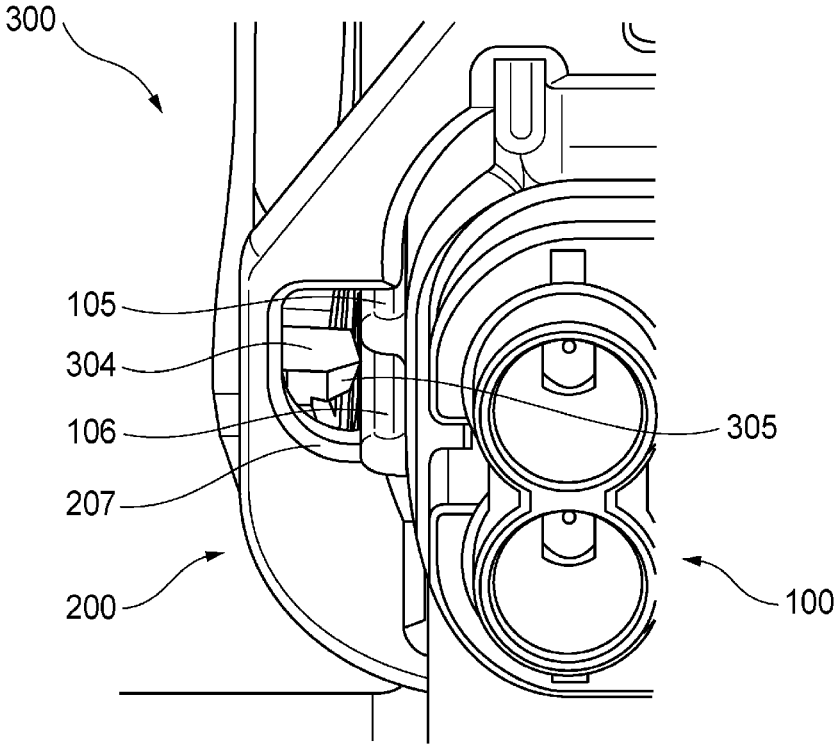
FIG. 7A is a perspective view illustrating the state illustrated in FIG. 6B when viewed from a side of the male housing.
Figure 7B:
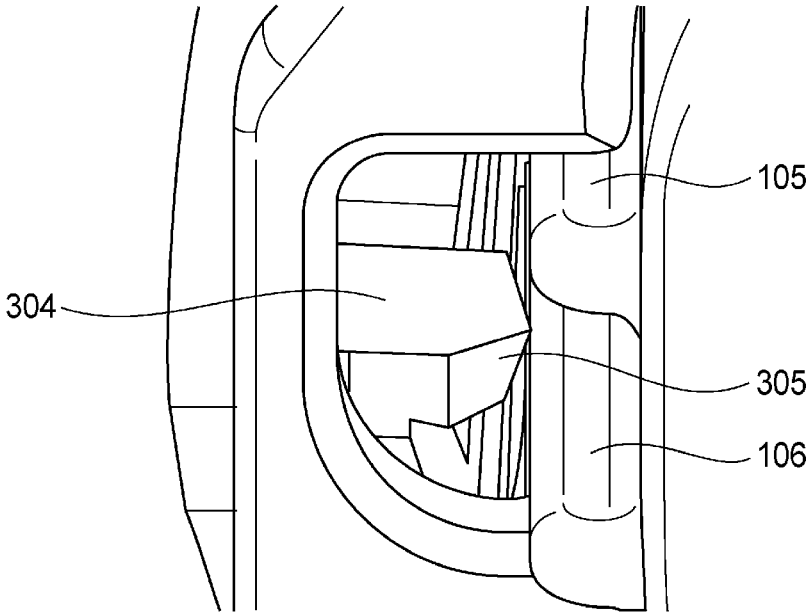
FIG. 7B is an enlarged perspective view illustrating the periphery of the lever-side lock part illustrated in FIG. 7A.

In the fitting start state, as illustrated in FIGS. 7A and 7B, the protrusion parts 305 of the pair of lever-side lock parts 304 are pressed by the pressing surfaces 109 in the pressing parts 108 of the pair of lower ribs 106 to ride on the pressing surfaces 109. Thus, as illustrated in FIGS. 8B and 9B, the pair of lever-side lock parts 304 are elastically deformed to the widthwise outer side (see arrows of FIGS. 8B and 9B).

Herein, as illustrated in FIGS. 8B and 9B, in the fitting start state, the tip of the protrusion part 305 of the lever-side lock part 304 is positioned on the widthwise inner side from the widthwise outer edge of the lower edge surface 206. On the other hand, the lower end of the taper surface 312 formed in the lower surface of the lever-side lock part 304 is positioned on the widthwise outer side from the widthwise outer edge of the lower edge surface 206.

Accordingly, when the forward moment in the turning direction is applied to the lever 300, the edge portion of the taper surface 312 is slid with respect to the widthwise outer edge of the lower edge surface 206 (the elastic deformation amount of the lever-side lock part 304 to the widthwise outer side is increased), and the lever-side lock part 304 is moved from the temporary locking position to the front side in the turning direction. That is, in the fitting start state, the lock of the lever-side lock part 304 by the lower edge surface 206 is released so that the lever 300 becomes movable from the temporary locking position to the final locking position.

As described above, when the taper surface 312 is formed in the lower surface of the lever-side lock part 304, although the tip of the lever-side lock part 304 is positioned on the widthwise inner side from the widthwise outer edge of the lower edge surface 206, the lever 300 is movable from the temporary locking position to the final locking position. In other words, by providing the taper surface 312, the lock of the lever-side lock part 304 by the lower edge surface 206 can be released easily, and the entire length in which the lever-side lock part 304 protrudes to the widthwise inner side can be increased.

When the entire protruding length of the lever-side lock part 304 to the widthwise inner side is increased, it is possible to increase an area of a shearing surface of the lever-side lock part 304 in which a maximum shearing force is generated when the external force is unintentionally applied to the lever 300. As a result, the maximum shearing force can be decreased, and thus a damage can be prevented which is caused by the shearing force of the lever-side lock part 304 when the external force is unintentionally applied to the lever 300.

As described above, in the fitting start state, the lever 300 is movable from the temporary locking position to the final locking position. Accordingly, in the fitting start state, when the male housing 100 is pressed with respect to the female housing 200 in the fitting direction, and the cam boss 107 presses the side wall 310 of the cam groove 306, and the lever 300 starts to turn from the temporary locking position toward the final locking position. In addition, in the fitting start state, when the forward moment in the turning direction is directly applied to the lever 300 by the manual operation and the like of the operator, the lever 300 starts to turn from the temporary locking position toward the final locking position.

Figure 6C:
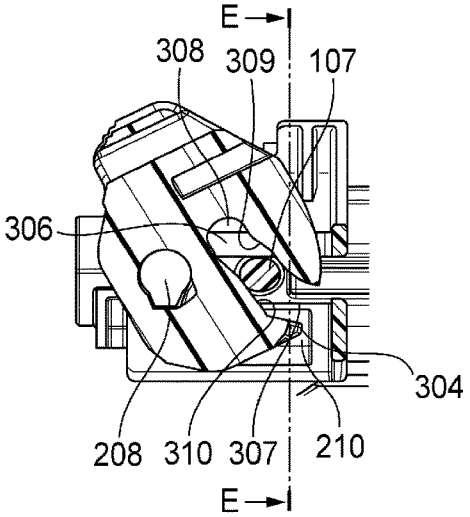
FIG. 6C illustrates the positional relation of the cam boss and the lever in a stage after the fitting start state of the male housing and the female housing.

As described above, when the lever 300 starts to turn from the temporary locking position toward the final locking position, as illustrated in FIGS. 6C and 8C, the protrusion part 305 of the lever-side lock part 304 deformed elastically moves toward the receiving surface 210 of the female housing 200 according to the forward turning of the lever 300 in the turning direction (see arrows of FIG. 8C). At that time, the protrusion part 305 of the lever-side lock part 304 is directed from the pressing surface 109 toward the receiving surface 210 through the tilted surface 110 along the turning direction.

Herein, as described above, the tilted surface 110 is tilted toward the widthwise outer side and the lower side with respect to the flat surface perpendicular to the fitting direction. In other words, in the tilted surface 110, the lever-side lock part 304 is tilted along the turning direction such that the protrusion part 305 of the lever-side lock part 304 is brought gradually into close to the receiving surface 210. Accordingly, after releasing the lock of the lever-side lock part 304, when the protrusion part 305 of the lever-side lock part 304 deformed elastically presses the tilted surface 110 during elastic recovery, the protrusion part 305 receives the reaction force directed to the lower side. In other words, an effect can be obtained which assists the turning of the lever 300 by the tilted surface 110. With the turning assisting effect, the force can be reduced which is required when the lever 300 starts to turn from the temporary locking position toward the final locking position, and the operation of the lever 300 is smoothly performed so as to improve an operation feeling.

The tilted surface 110 is formed to be arranged to fill a step between the pressing surface 109 and the receiving surface 210 and to be tilted when the protrusion part 305 of the lever-side lock part 304 is moved from the pressing surface 109 to the receiving surface 210 through the tilted surface 110. Accordingly, the lever-side lock part 304 further moves smoothly from the pressing surface 109 toward the receiving surface 210. As a result, the operation feeling of the lever 300 is improved further.

As illustrated in FIGS. 6C and 8C, the protrusion part 305 of the pair of lever-side lock parts 304 deformed elastically presses the receiving surface 210 during the elastic recovery when moving on the pair of receiving surfaces 210 (see FIGS. 5 to 6C) of the female housing 200.

Herein, the receiving surface 210 is tilted downward with respect to the flat surface perpendicular to the width direction. Accordingly, when the protrusion part 305 of the lever-side lock part 304 deformed elastically presses the receiving surface 210 during the elastic recovery, the protrusion part 305 receives the downward reaction force. The reaction force is received, and the lever 300 receives a force on the front side in the turning direction (to the final locking position). In other words, an effect is obtained in which the receiving surface 210 assists the turning of the lever 300. With the turning assisting effect of the receiving surface 210, the operation feeling when the lever 300 starts to turn from the temporary locking position toward the final locking position is improved.

After the protrusion parts 305 of the pair of lever-side lock parts 304 move on the pair of receiving surfaces 210, the lever 300 is turned toward the final locking position while the receiving surface 210 receives the turning assisting effect. Further, when the side wall 309 of the cam groove 306 presses the cam boss 107 toward the rear side of the female housing 200, the cam boss 107 (further, the male housing 100) is pulled toward the rear side of the female housing 200 according to the progressing of turning of the lever 300 (see FIG. 6C).

The protrusion part 305 of the lever-side lock part 304 frictionally moves on the receiving surface 210 according to the progressing of the turning of the lever 300. The turning assisting effect of the receiving surface 210 is gradually reduced as the elastic deformation amount of the lever-side lock part 304 is reduced according to the progressing of the forward turning of the lever 300 in the turning direction.

When the lever 300 is turned further toward the final locking position, the side wall 309 of the cam groove 306 further presses the cam boss 107 to the rear side of the female housing 200. Thus, the cam boss 107 (further, the male housing 100) is pulled further to the rear side of the female housing 200 according to the progressing of the turning of the lever 300.

When the lever 300 reaches the final locking position, the cam boss 107 reaches the innermost part 308 (see FIGS. 5 to 6C) of the cam groove 306, and the male housing 100 is in the fitting completion state. In addition, as described above, the lock beak holding part 311 (see FIG. 2A) of the lever 300 abuts on and is held by the lock beak 209 (see FIG. 2A) of the female housing 200. Accordingly, the conductive connection between the male terminal T1 and the female terminal T2 which are respectively provided in the male housing 100 and the female housing 200 is completed (see FIG. 4C), and the lever 300 is held in the final locking position.

Next, the arrangement of the cut-off parts 208*a* provided in the outer circumferential surfaces of the pair of rotary shafts 208 of the female housing 200 will be described with reference to FIGS. 11A to 12. In the rotary shaft 208, the pair of cut-off parts 208*a* are provided in the outer circumferential surface of the central portion of the rotary shaft 208 in an axial direction (width direction), so as to prevent a sink caused by the molding and contraction.

Figure 11A:
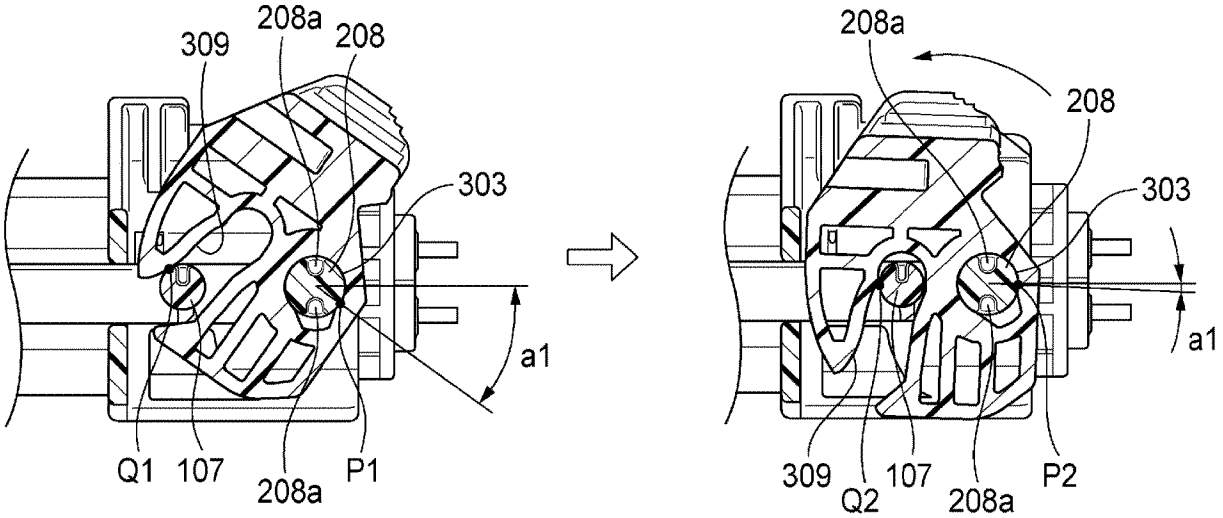
FIG. 11A is a sectional view for describing a range where an outer circumferential surface of a rotary shaft of the female housing receives a force from the lever when the lever is moved from the temporary locking position to the final locking position, corresponding to the cross section taken along line H-H of FIG. 10C.

As illustrated in FIG. 11A, when the lever 300 is moved from the temporary locking position to the final locking position, at the time of starting the movement, in the outer circumferential surface of the cam boss 107, the force is received at the point Q1 from the side wall 309 of the cam groove 306, and the outer circumferential surface of the rotary shaft 208 receives the force at the point P1 from the hole 303 of the lever 300. At the time of ending the movement, the outer circumferential surface of the cam boss 107 receives the force at the point Q2 from the side wall 309, and the outer circumferential surface of the rotary shaft 208 receives the force at the point P2 from the hole 303. Therefore, when the lever 300 is moved from the temporary locking position to the final locking position, only in the range (the range corresponding to the angle (a1-a2) in FIG. 12) between the point P1 and the point P2, the outer circumferential surface of the rotary shaft 208 receives the force more than the lever 300.

Figure 11B:
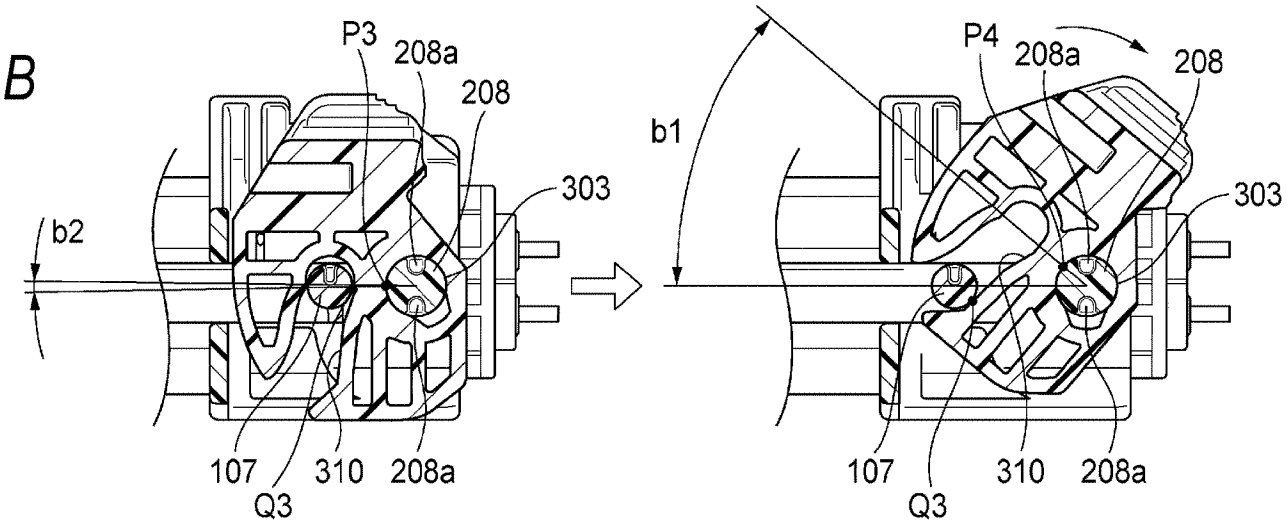
FIG. 11B is a sectional view for describing a range where the outer circumferential surface of the rotary shaft of the female housing receives the force from the lever when the lever is moved from the final locking position to the temporary locking position, corresponding to the cross section taken along line H-H of FIG. 10C.

Conversely, as illustrated in FIG. 11B, when the lever 300 is moved from the final locking position to the temporary locking position, at the time of starting the movement, the outer circumferential surface of the cam boss 107 receives the force at the point Q3 from the side wall 310 of the cam groove 306, and the outer circumferential surface of the rotary shaft 208 receives the force at the point P3 from the hole 303. At the time of ending the movement, the outer circumferential surface of the cam boss 107 receives the force at the point Q4 from the side wall 310, and the outer circumferential surface of the rotary shaft 208 receives the force at the point P4 from the hole 303. Therefore, when the lever 300 is moved from the final locking position to the temporary locking position, in only the range (the range corresponding to the angle (b1-b2) in FIG. 12) between the point P3 and the point P4, the outer circumferential surface of the rotary shaft 208 receives the force more than the lever 300.

Figure 12:
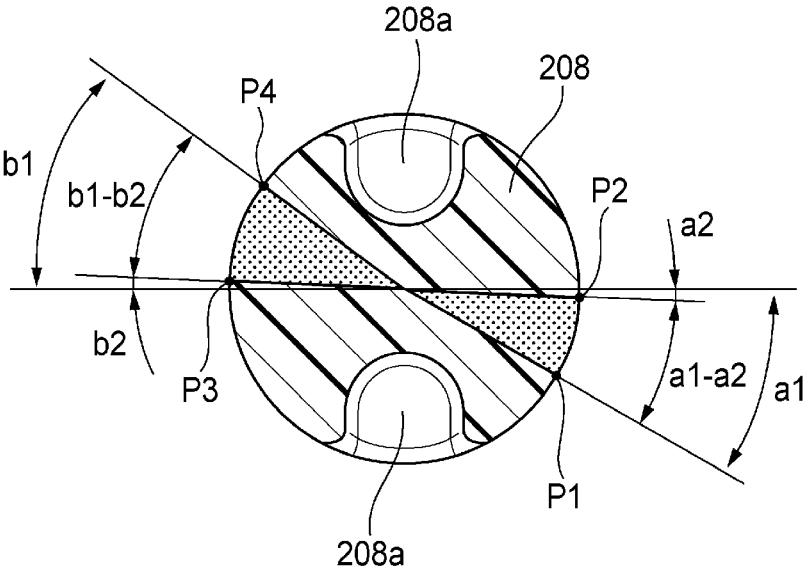
FIG. 12 is a view for describing an arrangement of a cut-off part provided in the rotary shaft of the female housing.

As can be understood from FIG. 12, in this example, the pair of cut-off parts 208*a* are provided in the outer circumferential surface of the rotary shaft 208 in a range where the force is not received from the lever 300 (more specifically, the inner wall surface of the hole 303) when the lever 300 is moved from the temporary locking position to the final locking position, and when the lever is moved from the final locking position to the temporary locking position. Specifically, the pair of cut-off parts 208*a* are provided in the upper end part and the lower end part in the outer circumferential surface of the rotary shaft 208, respectively.

As described above, the cut-off part 208*a* is provided in the outer circumferential surface of the rotary shaft 208 in a range where the force is not received from the lever 300, and the outer circumferential surface of the rotary shaft 208 can be maintained to be smooth over the entire range where the outer circumferential surface receives the force from the lever 300. Thus it is possible to maintain the operation feeling of the lever 300 favorably.

Hereinbefore, in the lever connector 1 according to the embodiment of the invention, when the connector is fitted completely so that the lever 300 is in the fitting completion position, the nipping wall 213 of the female housing 200 is brought into close contact with the guide part 314 of the lever 300, so as to prevent that the guide part 314 (that is, the arm part 301) of the lever 300 moves to the widthwise outer side. Accordingly, even when the vibration or the external force is applied from the outside to the lever connector 1, the displacement (rattling) of the lever 300 is prevented. As a result, it is possible to prevent abrasion or the like of the lever 300 and the female housing 200, and to maintain the original function of the lever 300. Therefore, the lever connector 1 having this configuration has excellent tolerance to the vibration or the external force applied from the outside.

The projection 212 provided in the female housing 200 is formed to push the arm part 301 adjacent to the root part of the guide part 314 of the lever 300 toward the nipping wall 213. Accordingly, the displacement (rattling) of the lever 300 is prevented more reliably. Accordingly, the lever connector 1 having this configuration has more excellent tolerance to the vibration or the external force applied from the outside.

The guide part 314 of the lever 300 covered with the nipping wall 213 is separated from the nipping wall 213 when the lever 300 is in the temporary locking position (fitting start position), and is covered with the nipping wall 213 when the lever 300 is in the final locking position (fitting completion position). Accordingly, when the lock between the lever-side lock part 304 and the lower edge surface 206 of the window 204 of the female housing 200 is released at the time of starting the fitting, the nipping wall 213 does not disturb the releasing. Accordingly, in the lever connector 1 having this configuration, the tolerance to the vibration or the external force applied from the outside can be improved without affecting a temporary locking mechanism of the lever 300.

Another Embodiment

Incidentally, the invention is not limited to the above-described embodiment, and various modifications can be adopted within the range of the invention. For example, the invention is not limited the above-described embodiment, but may be modified or improved appropriately. In addition, material, shape, size, number, location or the like of each component in the above-described embodiments are arbitrary and not limited as long as they can attain the invention.

For example, in the above-described embodiment, the projection 212 is provided in the female housing 200, and the projection 212 pushes the arm part 301 adjacent to the root part of the guide part 314 of the lever 300 toward the nipping wall 213. Whereas, as long as the nipping wall 213 is in close contact with the guide part 314 of the lever 300 when the lever 300 is in the final locking position (fitting completion position), such a projection 212 may not be provided in the female housing 200.

In the above-described embodiment, the nipping wall 213 is in close contact with the guide part 314 provided in the arm part 301 of the lever 300 when the lever 300 is in the final locking position (fitting completion position). Whereas, the guide part 314 may not be provided in the arm part 301 of the lever 300, and the nipping wall 213 may be in close contact with the edge part itself of the arm part 301 of the lever 300 when the lever 300 is in the final locking position (fitting completion position).

In the above-described embodiment, the lever 300 is mounted in the female housing 200 to be turnable about the rotary shaft 208. However, the lever 300 may be mounted in the female housing 200 to be slidingly movable with respect to the female housing 200.

Herein, the features of the embodiments of the lever connector 1 according to the invention will be simply summarized as the following [1] to [3].

[1] A lever connector (1) including:

a first housing (100);

a second housing (200) configured to be fit to the first housing (100), and including a housing-side lock part (206); and a lever (300), mounted in the second housing (200), and configured to be moved from a fitting start position to a fitting completion position, wherein the lever (300) includes a lever-side lock part (304) configured to be elastically deformed in a first direction (widthwise outer side) to be separated from a surface of the second housing (200) and configured to be locked to the housing-side lock part (206) when the lever (300) is in the fitting start position, the first housing (100) includes a pressing part (108) configured to move together with the first housing (100) in a fitting direction at a time of fitting, and configured to release a lock between the lever-side lock part (304) and the housing-side lock part (206) by pressing the lever-side lock part (304) in the first direction (widthwise outer side), and the second housing (200) includes a lap part (213) configured to be brought into close contact with an edge part (301, 314) of the lever (300) when the lever (300) is in the fitting completion position, so as to prevent that the edge part (301, 314) is deformed in the first direction (widthwise outer side).

[2] The lever connector (1) according to the above-described [1], wherein the second housing (200) includes a projection part (212) which protrudes to push the edge part (301) toward the lap part (213), when the lever (300) is in the fitting completion position.

[3] The lever connector (1) according to the above-described [1] or [2], wherein the lever (300) includes a guide part (314) provided in the edge part and configured to move together with the lever (300) at the time of fitting, and the guide part (314) is not covered with the lap part (213) when the lever (300) is in the fitting start position, and is covered with the lap part (213) when the lever (300) is in the fitting completion position.

With the lever connector according to the above configuration, when the connector is fitted completely so that the lever is in the fitting completion position, the lap part is brought into close contact with the edge part of the lever, so as to prevent that the edge part of the lever moves in the first direction (a direction to be separated from the surface of the second housing). Accordingly, even when the vibration or the external force is applied from the outside to the lever connector, the displacement (rattling) of the lever is prevented. As a result, it is possible to prevent abrasion or the like of the lever and the second housing, and to maintain the original function of the lever.

Therefore, the lever connector having this configuration has excellent tolerance to the vibration or the external force applied from the outside.

With the lever connector according to the above configuration, the projection part provided in the second housing is formed to push the edge part of the lever toward the lap part. Accordingly, the displacement (rattling) of the lever is prevented more reliably. Accordingly, the lever connector having this configuration has more excellent tolerance to the vibration or the external force applied from the outside.

With the lever connector according to the above configuration, the edge part (guide part) of the lever covered with the lap part is separated from the lap part when the lever is in the fitting start position, and is covered with the lap part when the lever is in the fitting completion position. Accordingly, when the lock between the lever-side lock part and the housing-side lock part is released at the initial time of the fitting, the lap part does not disturb the releasing. Accordingly, in the lever connector having this configuration, the tolerance to the vibration or the external force applied from the outside can be improved without affecting a temporary locking mechanism of the lever.

According to the invention, the lever connector can be provided which has excellent tolerance to the vibration or the external force applied from the outside.

What is claimed is:

1. A lever connector comprising:

a first housing;

a second housing, configured to be fit to the first housing, and including a housing-side lock part; and a lever, mounted in the second housing, and configured to be moved from a fitting start position to a fitting completion position, wherein the lever includes a lever-side lock part configured to be elastically deformed in a first direction to be separated from a surface of the second housing and configured to be locked to the housing-side lock part when the lever is in the fitting start position, the first housing includes a pressing part configured to move together with the first housing in a fitting direction at a time of fitting, and configured to release a lock between the lever-side lock part and the housing-side lock part by pressing the lever-side lock part in the first direction, and the second housing includes a lap part configured to be brought into close contact with an edge part of the lever when the lever is in the fitting completion position, so as to prevent that the edge part is deformed in the first direction.

2. The lever connector according to claim 1, wherein the second housing includes a projection part which protrudes to push the edge part toward the lap part, when the lever is in the fitting completion position.

3. The lever connector according to claim 1, wherein the lever includes a guide part provided in the edge part and configured to move together with the lever at the time of fitting, and the guide part is not covered with the lap part when the lever is in the fitting start position, and is covered with the lap part when the lever is in the fitting completion position.

* * * * *